US005454934A

United States Patent [19]

Reynolds et al.

[11] Patent Number: 5,454,934

[45] Date of Patent: Oct. 3, 1995

[54] COAL LIQUEFACTION USING ATOMICALLY DISPERSED METALS

[75] Inventors: Stephen D. Reynolds; Claude C. Culross; Stephen D. LeViness, all of Baton Rouge, La.; John W. Larsen, Bethlehem, Pa.

[73] Assignee: Exxon Research & Engineering Co., Florham Park, N.J.

[21] Appl. No.: 218,047

[22] Filed: Mar. 25, 1994

Related U.S. Application Data

[63] Continuation of Ser. No. 996,253, Dec. 23, 1992.

[51] Int. Cl.[6] ..... C10G 1/00

[52] U.S. Cl. ..... 208/423; 208/403; 208/428; 208/435

[58] Field of Search ..... 208/400, 403, 208/405, 419, 420, 430, 435, 423, 428

[56] References Cited

FOREIGN PATENT DOCUMENTS

| | | |
|---|---|---|
| 2807203 | 11/1978 | Germany . |
| 58-96696 | 6/1983 | Japan . |
| 1598612 | 9/1981 | United Kingdom . |

*Primary Examiner*—Asok Pal
*Assistant Examiner*—Bekir L. Yildirim
*Attorney, Agent, or Firm*—Henry E. Naylor

[57] ABSTRACT

A method for converting solid carbonaceous materials to liquid products. The solid carbonaceous material is first treated with a aqueous composition of a metal carbonate or bicarbonate. This results in the metal being atomically dispersed in the carbonaceous material. The treated solid carbonaceous material is then subjected to liquefaction conditions. The preferred metal is iron.

6 Claims, 1 Drawing Sheet

FIGURE
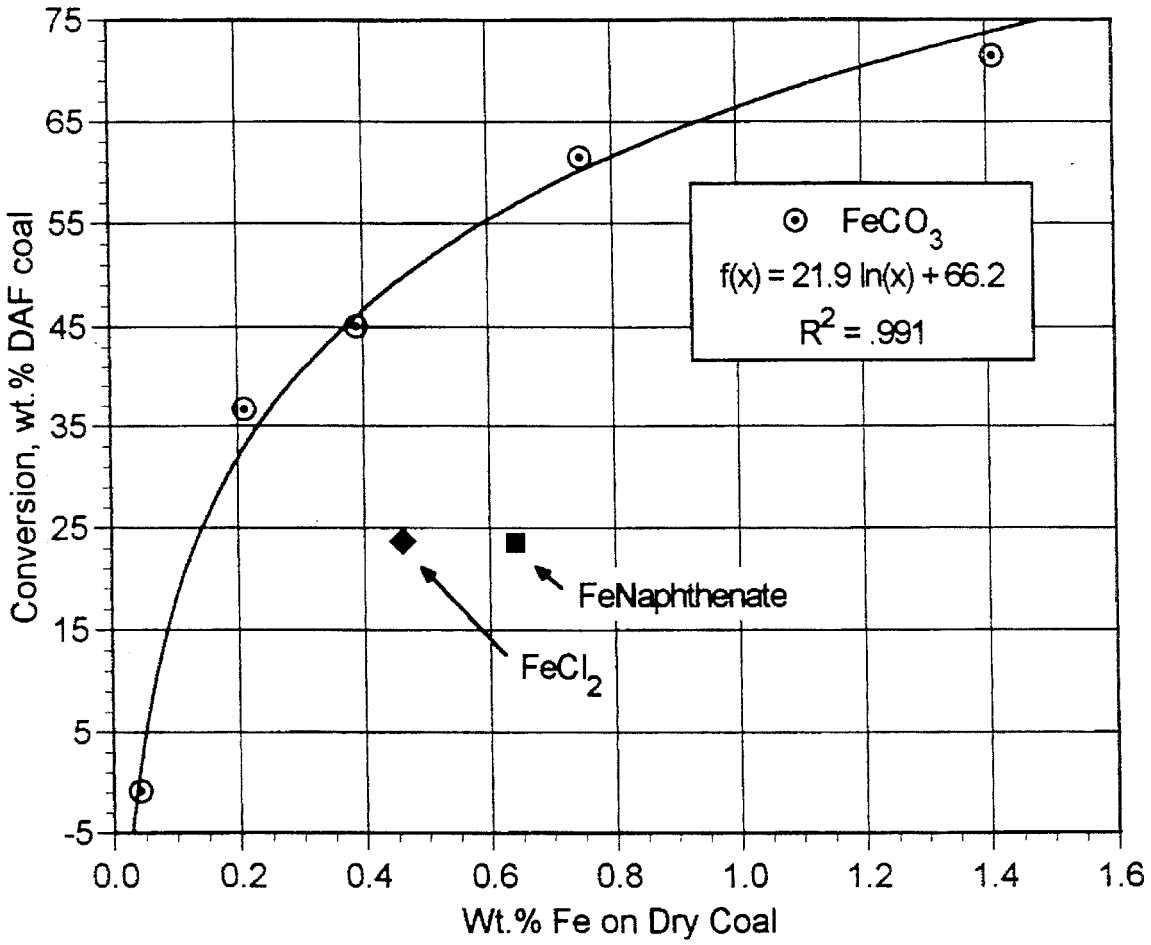

COAL LIQUEFACTION USING ATOMICALLY DISPERSED METALS

This application is a continuation of Ser. No. 07/996,253 now abandoned.

FIELD OF THE INVENTION

A method for converting solid carbonaceous materials to liquid products by: (a) atomically dispersing metals into said solid carbonaceous material containing sufficient acid functionality, which metals are catalytically active for converting the carbonaceous material to lower boiling products; and (b) subjecting the treated solid carbonaceous material to liquefaction conditions. The metals are dispersed in the solid carbonaceous material by contacting the carbonaceous material with an aqueous composition of a metal carbonate or bicarbonate. This results in the metal being atomically dispersed into the carbonaceous material. The preferred metal is iron.

BACKGROUND OF THE INVENTION

Although the costs of petroleum feedstocks have remained relatively stable in recent years, it is only a matter of time when the world will again be faced with shortages and escalating prices. Consequently, there is still a substantial amount of research being conducted on processes for producing synthetic fuels, including catalytic coal conversion, or liquefaction. Both supported and non-supported catalysts have been used. It is known in the art that supported hydroconversion catalysts are not as active for the conversion of coal to liquid products as are high surface area, well dispersed, non-supported slurry catalysts. Particularly active catalyst systems in the art, for the liquefaction of coal, are well dispersed transition metal, especially molybdenum, containing slurry catalysts. These catalysts are typically prepared by dispersing a Mo-containing catalyst precursor in a coal/solvent slurry, then thermally forming and activating the catalyst in-situ by the introduction of sulfur, either as solid sulfur, or as a sulfur-containing gas, typically $H_2S$. See, for example, U.S. Pat. No. 4,369,106.

It is taught in U.S. Pat. No. 4,077,867 that coal, in a hydrogen donor diluent, is liquefied in the presence of a catalyst prepared in situ in the coal/hydrogen-donor mixture from catalyst precursors which may be heteropolyacids, such as phosphomolybdic acid. Further, U.S. Pat. No. 4,136,013 teaches a coal liquefaction process wherein an emulsion of an aqueous solution of a metal salt in a water-immiscible liquid medium is added to the coal slurry. The metal salt is a water soluble salt such as or alkali metal heptamolybdate. However, owing to the difficulty of recovering the expensive transition metal after use, inexpensive metals, such as iron, have continued to be of interest as the basis of an economical and disposable catalyst for coal liquefaction.

Various studies have shown that the catalytic activity, obtained by conventional methods for the direct introduction of iron into the feed slurry, in the form of readily available minerals, such as oxide, or sulfide concentrates, is generally low. Such approaches are typically ineffective, or only moderately effective even when relatively high concentrations (wt. % based on coal) of iron are used. Among the factors contributing to such low activity are poor initial dispersion and relatively low surface area of the added iron phase. Another contributing factor is a tendency for the iron minerals to aggregate at conversion conditions, resulting in a loss of surface area of the catalytically active iron species.

A variety of techniques have been used to increase the initial dispersion of iron in coal. For example, catalyst precursors have been introduced by physically mixing very small particles of iron into the feed slurry. Iron has also been deposited by thermal decomposition of oil soluble forms. Iron has also been impregnated into the coal by use of water soluble iron compounds. When solubility is the means of contact with coal, catalyst precursors must of necessity possess relatively high solubility, e.g., in excess of several weight percents in water or oil. Two shortcomings with these approaches are that the iron ends up outside of the coal, and the resulting dispersion is not optimal, that is, it is not atomic.

One effective, but non-economical, method for dispersing iron in coal is taught in *Effect Of Activation Conditions On Dispersed Iron Catalysts in Coal Liquefaction*; by A. V. Cugini et al; U.S. Department of Energy; Preprint Paper—Americal Chemical Society, Division Fuels Chemistry, 36(1); pp 91–102, 1991. The process of that paper comprises combining both coal impregnation and precipitation techniques to generate a highly active dispersed iron catalyst having considerable promise for liquefaction. While such aforementioned techniques have met with varying degrees of success, there still remains a need in the art for even more effective and economical methods of dispersing catalytic metals into coal particles. None of the prior art methods can achieve the dispersion of the present invention wherein atomic dispersion of metal is accomplished by contacting the carbonaceous material with a metal precursor in a single step.

SUMMARY OF THE INVENTION

In accordance with the present invention, there is provided a method for converting solid carbonaceous material to liquid products, which method comprises: (a) treating the solid carbonaceous material with an aqueous composition of one or more metal compounds selected from metal compounds having at least one anion which is carbonate or bicarbonate, at an effective temperature and time, wherein said solid carbonaceous material contains a sufficient amount of acid functionality to react with the metal compounds, thereby resulting in the atomic dispersion of said metals in the carbonaceous material; and (b) subjecting the treated solid carbonaceous material to liquefaction conditions.

In a preferred embodiment of the present invention, the treated solid carbonaceous material is separated from the spent aqueous-based composition.

In another preferred embodiment of the present invention, the separated treated solid carbonaceous material is dried.

In yet another preferred embodiment, the metal compound is iron carbonate.

In still another preferred embodiment, the solid carbonaceous material is coal, particularly bituminous or subbituminous coal.

BRIEF DESCRIPTION OF THE FIGURE

The sole figure is a log fit of the data of the examples hereof of conversion of coal versus wt. % Fe on dry coal.

DETAILED DESCRIPTION OF THE INVENTION

As previously mentioned, the present invention relates to an improved method for the liquefaction of carbonaceous materials wherein catalytically active metals are atomically dispersed into carbonaceous material prior to liquefaction.

The method for dispersing the metals involves only a single catalyst forming step. That is, the single step of treating the carbonaceous material with a metal compound wherein at least one anion is carbonate or bicarbonate. It will be understood that the present invention can be practiced on carbonaceous materials in both the liquid and solid form. Preferred are solid carbonaceous materials, such as coals.

By effective amount of acidic functionality, we mean that the carbonaceous material will contain at least that minimum level of acidic functionality which will chemically react with the carbonate or bicarbonate to result in the metal being atomically dispersed in the carbonaceous material. Preferred solid carbonaceous materials are those which are naturally occurring and which inherently contain an effective amount of acidic functionality. Non-limiting examples of naturally occurring carbonaceous materials suitable for use in the present invention include bituminous, subbituminous, and lignite coals; peats; as well as any other suitable solid naturally occurring carbonaceous materials employed in the various carbonaceous conversion processes.

If it is desired to use a carbonaceous material which does not inherently contain an effective amount of acidic functionality, then an effective amount of acidic functionality can be incorporated into the material by any appropriate technique. For example, if the carbonaceous material is carbon, or a liquid hydrocarbonaceous material such as petroleum feedstock, the material can first be treated with a solution of a strong acid, such as sulfuric or nitric acid. The resulting acidic carbonaceous material can then be contacted with the metal carbonate and/or bicarbonate compound of the present invention, and the metal atomically dispersed therein.

Any metal compound which contains at least one anion which is a carbonate or bicarbonate can be used in the practice of the present invention to atomically disperse the metal into the carbonaceous material. Preferred are those wherein the metal is selected from Group VIIIA, preferably Fe, Ni and Co, more preferably Fe; Group IIB, preferably Zn; Group IB, preferably Ag and Cu; and Group IVB, preferably Pb. The Groups referred to herein are Groups of the Periodic Table of the Elements as published by Sargent-Welch Scientific Co., catalog number S-18806, 1979 edition. When the carbonaceous material is coal, the preferred metal carbonate is iron carbonate.

While a pre-manufactured metal carbonate can be used in the practice of the present invention, it may be desirable to prepare the carbonate just prior to its being contacted with the carbonaceous material. This is because the preferred carbonate, $FeCO_3$, is unstable toward oxygen. Consequently, great difficulties would be encountered in obtaining premanufactured iron carbonate having sufficient purity for use in the present invention. Other carbonates and bicarbonates are stable toward oxygen.

Any appropriate method may be used to prepare the metal carbonate or bicarbonate material. When the carbonate is iron carbonate, it is required that the starting materials be purged of air and the preparation be conducted in an inert environment because of the oxidatively unstable nature of the iron carbonate. The starting materials, for example iron(II) chloride or sulfate, and a soluble carbonate, such as sodium carbonate, are each separately dissolved in deoxygenated water. The two resulting solutions are combined and iron carbonate is formed as a white flocculate. The iron carbonate can then be recovered by any appropriate filtration technique, washed with deoxygenated water to remove excess sodium carbonate, sodium chloride, and sodium sulfate by-product.

The resulting iron carbonate can then be introduced into a slurry of solid carbonaceous material or liquid carbonaceous material containing at least an effective amount of water. The liquid of the slurry can be either all water, or a mixture of hydrocarbon solvent containing at least an effective amount of water. That is, at least that minimum amount of water needed to effect substantially complete contact of the carbonaceous material with the aqueous phase which will contain the iron carbonate. An effective temperature and time is also needed to ensure substantial atomic dispersion of the metal into the carbonaceous material. Preferred temperatures would be from about ambient temperature (about 22° C.) to about 300° C., preferably from about ambient temperature to about 200° C., and more preferably from about ambient temperature to about 150° C. Optionally, $CO_2$ pressure may be used to enhance solubility. Effective pressure would be from about atmospheric pressure to 400 psi $CO_2$, preferably from about atmospheric pressure to about 200 psi $CO_2$, and more preferably from about atmospheric pressure to 80 psi.

It is believed that the metal carbonate material used in the present invention is effective for atomically dispersing the metal into the carbonaceous material because the carbonate/bicarbonate anion is basic enough to chemically react with the acid groups of the carbonaceous material, particularly the carboxylic acid groups of coal. The reaction is driven to completion in only one catalyst forming, or contacting, step. The chemical reaction chemically bonds the metal to the carbonaceous material. This results in the metal having the greatest possible dispersion in the carbonaceous material; that is, atomic dispersion. This cannot be said of any of the prior art techniques for placing metals into carbonaceous materials because prior art techniques typically use water-soluble metals salts, such as iron chloride, which are not basic enough to react with the acid groups of the carbonaceous material. That is, there is no reaction with the acid functionality of the carbonaceous material, such as coal, because the anion of such metal salts are generally non-basic. Even in those instances where the anion is basic, its basicity is so weak that the reaction is equilibrium-limited. In the former case, association of the metal and the carbonaceous material must, by necessity, only be physical, with the attendant poor contact and dispersion. In the later case, it is believed that equilibrium limits the amount of chemical association to an extent far less than the full acid content of the carbonaceous material, so that any metal over and above the equilibrium limitation will be physically deposited on the solid carbonaceous material—again a relatively poor contact and dispersion.

Also, no other method produces a relatively harmless gas, $CO_2$, as its sole by-product, thus driving the metal dispersion reaction to completion. Only by practice of the present invention can a metal, such as iron, be atomically dispersed on a solid carbonaceous material, such as coal; or in a hydrocarbonaceous liquid, to such a degree that a substantial increase in activity results. Furthermore, in the catalyst forming step of the present invention, $CO_2$, a product of the reaction of carbonate with the carbonaceous material, is collected overhead. In conventional processes, anions, such as chlorides and sulfates, remain in the system by use of other oil and water-soluble metal salts. Furthermore, anions such as chloride can present corrosion problems. In contrast, there is no residue from the anion left in solution, or with the metal, by the practice of the present invention.

The carbonaceous material containing the atomically dispersed catalytically active metal can now be subjected to conversion conditions. For example, if the carbonaceous material is coal, conventional coal liquefaction conditions can be used. The liquefaction will preferably be practiced in the presence of a diluent. The diluent will generally be a hydrocarbonaceous coal derived solvent from a coal liquefaction process. The hydrocarbonaceous solvent may have an initial boiling point as low as about 175° C., preferably about 290° C., and more preferably as low as about 370° C. All boiling points, unless otherwise specificed, are at atmospheric pressure. Other suitable diluents include: hydrocarbonaceous streams boiling between about 175° C. and 540° C., preferably between about 200° C. and 370° C., and which are derived from coal liquefaction processes, which may include compounds that are hydrogen donors under temperature and pressure conditions employed in the liquefaction zone; other hydrogen-rich diluents may be used instead of, or in addition to, such coal-derived liquids; heavy hydrocarbonaceous oils, including heavy petroleum crude oils; residual oils such as atmospheric residua (boiling above about 340° C.); petroleum vacuum residua (boiling above about 565° C.); tars; bitumen; tar sand oils; shale oils; light diluents such as aromatic compounds; and hydrocarbonaceous compounds or oils boiling below about 175° C., and mixtures of any of these diluents. The diluents may be hydrogen donor diluents or non-hydrogen donor diluents.

The conversion, or liquefaction zone can be maintained at a temperature ranging from about 200° C. to about 540° C., preferably from about 300° C. to about 470° C. Pressures will typically be at superatmospheric hydrogen partial pressure e.g. of 100 psig or higher, preferably from about 500 to about 5000 psig partial pressure of hydrogen. Reaction time of about 5 minutes to several hours may be used, preferably from about 15 minutes to about 4 hours. If desired, the hydroconversion can be conducted with staged temperatures. In such a staged operation, the first stage is usually operated at a lower temperature than the second stage, for example, at least 10° C. lower, preferably at least 25° C. lower, and more preferably at least 50° C. lower. The mixture of coal, diluent and catalyst under hydroconversion conditions in the reaction zone with a hydrogen-containing gas effects hydroconversion of the coal to a hydrocarbonaceous oil. The hydroconversion zone oil product containing catalytic solids is removed from the hydroconversion reaction zone. The catalytic solids may be separated from the hydroconversion zone oil product by conventional means, for example, by distillation. At least a portion of the separated catalytic solids or solids concentrate may be recycled directly to the hydroconversion zone or recycled to the chargestock. Said solids concentrate may be generated from the separated catalytic solids. This can be accomplished by treating it with carbon monoxide at sufficient temperature to form metal or metal carbonyl compounds from the catalytic metal. Separation of the metal-rich fraction from a hydrocarbon-rich fraction by volatility or magnetism can then be accomplished. The hydrocarbon-rich fraction may have enhanced value for subsequent conversion. A portion of the hydrocarbonaceous oil product may also be recycled to the chargestock or to the hydroconversion zone. The conversion process may be conducted either as a batch or a continuous type operation. Such a continuous operation may be either of the plug flow or backmixed type and may be carried out either in a single reactor or in multiple reactors in series or in parallel configuration. CO—$H_2O$ may be used in place of or in combination with $H_2$, and the coal may also be pretreated with CO and $H_2O$ at a temperature from about 290° C. to 345° C., as taught in U. S. Pat. No. 5,110,450, which is incorporated herein by reference.

The following examples are provided for illustrative purposes and should not be taken as being limiting in any way.

EXAMPLE 1

0.1362 g $FeCl_2$ and 0.1253 g $Na_2CO_3$ were separately dissolved in water and then combined. The resulting white precipitate of $FeCO_3$ was filtered, washed, and added to a slurry of coal made from 11.87 g Rawhide coal (15.75 wt. % moisture; 10.00 g "dry" coal) slurried in 100 ml water. After transferring the $FeCO_3$ into the coal slurry, a hard vacuum was immediately pulled on the coal slurry for several minutes, and then a stopcock adapter was closed to seal the flask under vacuum. The slurry effervesced for several hours, indicating $CO_2$ evolution from reaction of $FeCO_3$ with coal. The iron content of the sample was increased from 0.22 wt. % to 0.76 wt. % on a "dry" coal basis.

Evolution of gaseous $CO_2$ upon contact of virtually any carbonate mineral with acid is a well known chemical reaction. For example, this is the fizzing observed when vinegar, which contains an organic carboxylic acid called acetic acid, is added to baking powder, which is sodium carbonate. Coals, too, contain carboxylic acids present as distinct groups within the organic structure. Iron carbonate and coal carboxylic acids in the aqueous composition of this invention undergo an acid-base neutralization reaction, after which iron is chemically bonded to the coal as an organic chelate (as shown in the equation below). It is by this acid-base chemistry that iron becomes atomically dispersed, i.e. , each iron is separated from every other iron.

$$2(\text{COAL})\text{-}CO_2H+FeCO_3 \rightarrow (\text{COAL-}CO_2)_2Fe+H_2O+CO_2$$

EXAMPLE 2

A sample of Rawhide coal containing a higher loading of iron was made by preparing $FeCO_3$ from 0.4539 g $FeCl_2$ and 0.3796 g $Na_2CO_3$ and reacting it with 11.87 g Rawhide coal (15.75 wt. % moisture; 10.00g "dry" coal), as described in Example 1. The iron content of the sample was brought to 1.42 wt. %.

EXAMPLE 3

A sample of Rawhide coal containing 3.56 wt. % Fe in coal was made by preparing $FeCO_3$ from 2.837 g $FeCL_2$ and 2.372 g $Na_2CO_3$. $FeCO_3$ was reacted with 29.76 g Rawhide coal (15.75 wt. % moisture; 25g "dry" coal) as previously described in Example 1, except that a vacuum was pulled on the reaction slurry several times during the course of the reaction because of the large theoretical volume of $CO_2$ by-product.

EXAMPLE 4

Rawhide coal was extracted with a large excess of citric acid in refluxing water for 24 hours to remove the native iron. The coal was next washed with refluxing water in the thimble of a soxhlet apparatus until the wash tested neutral to pH paper (ca. 8 days), then dried. Iron analysis of this iron-depleted coal showed 0.052 wt % residual iron.

EXAMPLE 5

An aliquot of the iron-depleted coal of Example 4 was reacted with $FeCO_3$ as described in Example 1. The iron content of the coal was brought to 0.40 wt % on a "dry" coal basis.

EXAMPLE 6

A solution of $FeCl_2$ was mixed with an aliquot of the iron-depleted coal of Example 4, and the water was evaporated to deposit the compound on the coal. The iron content of the coal was brought to 0.47 wt % on a "dry" coal basis.

Unlike iron carbonate, $FeCl_2$ is not a chemical base, and is therefore incapable of reacting with coal carboxylic acids in an acid-base neutralization reaction of the type shown in the above equation. Therefore, iron from $FeCl_2$ does not become chemically bonded to coal as discrete iron atoms separated from every other iron atom. Instead, $FeCl_2$ remains as $FeCl_2$. When the water of the $FeCl_2$ solution is evaporated, $FeCl_2$ precipitates from solution as aggregates, each consisting of many $FeCl_2$ entities. These aggregates are not chemically bonded to coal, but are merely physically deposited, and they represent a poorer dispersion than the optimal atomic dispersion obtained with $FeCO_3$.

EXAMPLE 7

An aliquot of the iron-depleted coal of Example 4 was mixed with an equal weight of hydrocarbon oil derived from Rawhide coal. To this was added a sufficient quantity of iron naphthenate to provide 0.65 wt % iron on a "dry" coal basis.

As an oil soluble material, iron naphthenate does not have physical association with coal as does deposited $FeCl_2$ because it is dissolved in the hydrocarbon solvent. Neither does iron naphthenate have chemical bonding to coal because it is not a chemical base, and is therefore incapable of the type of acid-base neutralization reaction shown in Equation 1 which is the means to atomically disperse the metal. Thus, it will lack the chemical bonding and atomic dispersion afforded by reaction of $FeCO_3$ with coal carboxylic acids.

EXAMPLE 8

Raw Rawhide coal was mixed with an equal weight of hydrocarbon oil derived from Rawhide coal and a sufficient amount of elemental sulfur to provide 1.0 wt % sulfur on a "dry" coal basis. Under hydrogen pressure, the coal was hydroconverted at conditions of 425° C., 120 min, and 250 cpm agitation (vertical 3" stroke). The hydrogen charged was present in an amount equal to 9 wt % of the dry coal weight ("hydrogen treat"), and the initial pressure at conditions was about 2000 psi. Per cent conversion was defined by difference, and was equal to 100—cyclohexane insolubles, expressed on a dry, ash free basis ("daf"). Conversion of raw Rawhide coal was 36.8 wt % daf.

EXAMPLE 9

An aliquot of the iron-depleted coal of Example 4 was hydroconverted as described in Example 8. No hydroconversion was observed, as evidenced by a weight of cyclohexane insolubles recovered after the run which was slightly greater than the weight of coal charged.

EXAMPLE 10

An aliquot of the coal of Example 5 (iron-depleted and reacted with $FeCO_3$) was hydroconverted as described in Example 8, except that the sulfur added was in excess of the amount needed to establish a 2:1 S:Fe atomic ratio by 1.0 wt % (coal basis). Conversion was 45.2 wt % daf.

EXAMPLE 11

An aliquot of the coal of Example 1 (raw Rawhide reacted with $FeCO_3$) was hydroconverted as described in Example 8, except that the sulfur added was in excess of the amount needed to establish a 2:1 S:Fe atomic ratio by 1.0 wt % (coal basis). Conversion was 61.6 wt % daf.

EXAMPLE 12

An aliquot of the coal of Example 2 (raw Rawhide reacted with $FeCO_3$) was hydroconverted as described in Example 8, except that the sulfur added was in excess of the amount needed to establish a 2:1 S:Fe atomic ratio by 1.0 wt % (coal basis). Conversion was 71.6 wt % daf.

EXAMPLE 13

An aliquot of the coal of Example 6 (iron-depleted coal onto which $FeCl_2$ was deposited) was hydroconverted as described in Example 8, except that the sulfur added was in excess of the amount needed to establish a 2:1 S:Fe atomic ratio by 1.0 wt % (coal basis). Conversion was 23.8 wt % daf.

EXAMPLE 14

An aliquot of the coal of Example 7 (iron-depleted mixed with hydrocarbon solvent and iron naphthenate) was hydroconverted as described in Example 8, except that the sulfur added was in excess of the amount needed to establish a 2:1 S:Fe atomic ratio by 1.0 wt % (coal basis). Conversion was 23.7 wt % daf.

EXAMPLE 15

An aliquot of the coal of Example 2 (raw Rawhide reacted with $FeCO_3$) was hydroconverted as described in Example 8, except that the sulfur added was in excess of the amount needed to establish a 2:1 S:Fe atomic ratio by 1.0 wt % (coal basis), residence time was 3 hr, hydrocarbon solvent:coal ratio was 1.6:1, and hydrogen treat was 12 wt %. Conversion was 80.8 wt % daf.

EXAMPLE 16

The hydroconversions in Examples 8–14 were plotted against the respective iron contents in the coals of Examples 1–2, Examples 4–7, and raw Rawhide coal. Two things are seen by this plot (FIG. 1).

First, iron chemically bonded and atomically dispersed by reaction of $FeCO_3$ with coal is by far the most active iron form.

0.40 wt % iron introduced by $FeCO_3$ reaction is much more active than 0.47 wt % iron deposited as water soluble $FeCl_2$, or 0.65 wt % iron added as oil-soluble iron naphthenate. This is shown by the three data points (⊙, ♦, and ■), having conversions of 45, 24, and 24 wt %, respectively. Any hydroconversion activity exhibited is due to added iron, since the iron-depleted coal itself has virtually zero hydroconversion activity (Example 9). Differences in the activity of the iron forms reflect that iron put into coal by $FeCO_3$ reaction has superior contact and dispersion in coal.

Second, iron chemically bonded and atomically dispersed in coal by this invention produces a marked increase in hydroconversion activity at higher iron loadings up to 1.42 wt %. (This is not a limit, but merely represents the highest loading tested.)

The dependence of hydroconversion activity on iron content is shown by the curve in the Figure, which has an $R^2$ of 0.991. If the added iron were not being highly utilized at increased loadings, it would be expected that hydroconversions would fall below the line, as is the case with $FeCl_2$ (♦, FIG. 1) and iron naphthenate (■, FIG. 1).

What is claimed is:

1. A method for converting naturally occurring solid carbonaceous material to liquid products, which method comprises: (a) treating the carbonaceous material with an aqueous composition of at least one metal compound selected from metal compounds wherein at least one anion is carbonate or bicarbonate, wherein the metal is selected from Fe, Ni, Co, Zn, Ag, Cu, and Pb, and wherein the metal carbonate has a solubility in water of equal to or less that 0.05 wt. %, at a temperature from about 22° C. to about 300° C. and at an effective time to allow complete evolution, by vacuum, of $CO_2$ by-product, wherein said naturally occurring solid carbonaceous material contains a sufficient amount of acid functionality to react with the metal compounds, thereby resulting in the atomic dispersion of said metals in the carbonaceous material; and (b) subjecting the treated solid carbonaceous material to liquefaction conditions.

2. The method of claim 1 wherein the solid carbonaceous material is a coal.

3. The method of claim 2 wherein the metal is selected from the group consisting of Fe, Ni, Co, and Zn.

4. The method of claim 2 wherein the treated coal is separated from the spent aqueous composition.

5. The method of claim 4 wherein the metal carbonate is iron carbonate.

6. The method of claim 3 wherein the treated coal, which is separated from the spent aqueous composition, is dried.

* * * * *